US011143059B2

(12) United States Patent
Abrahamson et al.

(10) Patent No.: US 11,143,059 B2
(45) **Date of Patent: *Oct. 12, 2021**

(54) TAPPET ASSEMBLY WITH UNGROUND OUTER CUP

(71) Applicant: Koyo Bearings North America LLC, Greenville, SC (US)

(72) Inventors: Scott Abrahamson, Piedmont, SC (US); Mark Brandolin, Greenville, SC (US)

(73) Assignee: Koyo Bearings North America LLC, Greenville, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/063,264

(22) Filed: Oct. 5, 2020

(65) Prior Publication Data

US 2021/0102478 A1 Apr. 8, 2021

Related U.S. Application Data

(60) Provisional application No. 62/910,157, filed on Oct. 3, 2019, provisional application No. 62/910,173, filed on Oct. 3, 2019.

(51) Int. Cl.
*F01L 1/14* (2006.01)

(52) U.S. Cl.
CPC ..... *F01L 1/14* (2013.01); *F01L 2305/02* (2020.05); *F01L 2307/00* (2020.05)

(58) Field of Classification Search
CPC ..... F01L 1/14; F01L 1/143; F01L 2305/02; F01L 2307/00
USPC ..... 123/90.48, 90.5
See application file for complete search history.

(56) References Cited

U.S. PATENT DOCUMENTS

| | | | |
|---|---|---|---|
| 1,613,117 | A | 1/1927 | Miller |
| 1,848,083 | A | 3/1932 | Wetherald |
| 2,891,525 | A | 6/1959 | Moore |
| 4,317,433 | A | 3/1982 | Fuhrmann |
| 4,335,685 | A | 6/1982 | Clouse |

(Continued)

FOREIGN PATENT DOCUMENTS

| | | | |
|---|---|---|---|
| DE | 3149356 | A1 | 6/1983 |
| DE | 3820645 | A1 | 12/1989 |

(Continued)

*Primary Examiner* — Jorge L Leon, Jr.
(74) *Attorney, Agent, or Firm* — Nelson Mullins Riley & Scarborough LLP

(57) ABSTRACT

A tappet assembly including an outer cup having a substantially cylindrical side wall, an annular lip portion disposed at a first end of the side wall, and an annular ledge disposed on the side wall, the annular ledge being disposed in a plane that is transverse to a longitudinal center axis of the tappet assembly. An inner cup includes an annular lip extending outwardly therefrom and a pair of shaft apertures, and is disposed in the outer cup so that the lip abuts the annular ledge of the outer cup and is non-rotatably fixed thereto by the annular lip of the outer cup which abuts the lip of the inner cup. A shaft is received in the shaft apertures, and a roller tappet is rotatably received on the shaft such that a portion of the roller tappet extends axially outwardly beyond the annular lip portion of the outer cup, and an anti-rotation feature formed in the outer cup, wherein the outer surface of the outer cup is an unground surface.

4 Claims, 5 Drawing Sheets

(56) References Cited

U.S. PATENT DOCUMENTS

| | | | | |
|---|---|---|---|---|
| 4,829,950 | A | 5/1989 | Kanamaru et al. | |
| 5,239,953 | A | 8/1993 | Shida | |
| 5,280,771 | A | 1/1994 | Groh et al. | |
| 5,454,353 | A * | 10/1995 | Elendt | F01L 13/0036 123/90.16 |
| 5,553,512 | A | 9/1996 | Harimoto | |
| 5,664,530 | A | 9/1997 | Ammon et al. | |
| 5,904,123 | A | 5/1999 | Ammon et al. | |
| 5,954,020 | A | 9/1999 | Schmidt et al. | |
| 5,975,038 | A | 11/1999 | Fischer et al. | |
| 5,979,385 | A | 11/1999 | Speil et al. | |
| 6,192,846 | B1 | 2/2001 | Speil | |
| 6,619,251 | B2 | 9/2003 | Kobayashi et al. | |
| 6,684,838 | B2 | 2/2004 | Pluta et al. | |
| 7,143,731 | B2 | 12/2006 | Kirbach et al. | |
| 7,159,552 | B2 | 1/2007 | Backert et al. | |
| 7,793,583 | B2 | 9/2010 | Radinger et al. | |
| 8,201,532 | B2 | 6/2012 | Prokop | |
| 8,235,018 | B2 | 8/2012 | Dorn et al. | |
| 8,474,427 | B2 | 7/2013 | Dorn et al. | |
| 8,863,716 | B2 | 10/2014 | Dorn | |
| 9,032,863 | B2 | 5/2015 | Chambonneau et al. | |
| 9,243,521 | B2 | 1/2016 | Cornett et al. | |
| 10,119,607 | B2 | 11/2018 | Abrahamson | |
| 10,385,957 | B2 | 8/2019 | Abrahamson | |
| 2007/0215088 | A1 | 9/2007 | Haefner | |
| 2008/0190237 | A1* | 8/2008 | Radinger | F01L 1/143 74/569 |
| 2010/0000476 | A1* | 1/2010 | Kunz | F01L 1/14 123/90.5 |
| 2010/0229812 | A1* | 9/2010 | Dorn | F02M 59/102 123/90.5 |
| 2012/0125277 | A1 | 5/2012 | Chambonneau et al. | |
| 2013/0340695 | A1 | 12/2013 | Fujii et al. | |
| 2015/0090209 | A1* | 4/2015 | Berruet | F02M 37/06 123/90.26 |
| 2015/0090211 | A1 | 4/2015 | Champalou | |
| 2015/0192098 | A1 | 7/2015 | Dorn et al. | |
| 2015/0337941 | A1 | 11/2015 | Champalou et al. | |
| 2015/0361937 | A1 | 12/2015 | Geyer et al. | |
| 2016/0160986 | A1* | 6/2016 | Berruet | F16H 53/06 74/569 |
| 2017/0299037 | A1 | 10/2017 | Abrahamson | |
| 2017/0342951 | A1* | 11/2017 | Xu | F02M 59/102 |
| 2019/0063580 | A1 | 2/2019 | Abrahamson | |
| 2019/0085731 | A1* | 3/2019 | Xu | F01L 1/14 |

FOREIGN PATENT DOCUMENTS

| | | | |
|---|---|---|---|
| DE | 10360467 | A1 | 7/2005 |
| DE | 102013216562 | A1 | 2/2015 |
| EP | 2853697 | A1 | 4/2015 |
| EP | 2853699 | A1 | 4/2015 |
| GB | 1349040 | A | 3/1974 |
| GB | 1354338 | A | 6/1974 |
| JP | S5540269 | A | 3/1980 |
| JP | H03-294653 | A | 12/1991 |
| JP | 2004257286 | A | 9/2004 |
| JP | 2010-511834 | A | 4/2010 |
| JP | 2011094596 | A | 5/2011 |
| JP | 2013-217304 | A | 10/2013 |
| JP | 2015068503 | A | 4/2015 |
| KR | 10-2012-0067313 | A | 6/2012 |
| WO | 2006018069 | A1 | 2/2006 |
| WO | 2012013376 | A1 | 2/2012 |
| WO | 2015106051 | A1 | 7/2015 |

* cited by examiner

TAPPET ASSEMBLY WITH UNGROUND OUTER CUP

CLAIM OF PRIORITY

This application claims the benefit of U.S. provisional patent application No. 62/910,157 filed Oct. 3, 2019, and U.S. provisional patent application number filed 62/910,173 filed Oct. 3, 2019, the disclosures of which are incorporated by reference in their entirety.

FIELD OF THE INVENTION

The present invention relates generally to tappet assemblies. More particularly, the present invention relates to designs and assembly methods of tappet assemblies and their associated alignment devices.

BACKGROUND OF THE INVENTION

Tappet assemblies are often used in a valve train of an internal combustion engine to transmit motion from a camshaft of the engine to one or more intake or exhaust valves. As the camshaft rotates, the tappet assemblies receive both a sideways force and a downward force from corresponding lobes on the camshaft, but only transmit the downward force to the valves to open and/or close the valves. Tappet assemblies thereby reduce the possibility of bending or otherwise damaging the valve stems of the valves. As well, tappet assemblies are often used in camshaft driven, high-pressure fuel pumps which are used in gasoline direct injection systems.

Existing bucket-type tappet assemblies typically include either a stamped or cold formed bucket. A roller tappet is typically supported on a shaft that is directly fixed to the bucket such as by staking, swaging, etc. As such, the bucket is a load bearing member and, therefore, requires heat treatment and operations such as grinding. As well, tappet assemblies often have some form of alignment device carried in an aperture defined by the bucket such that rotation of the tappet assemblies within its corresponding bore is prevented. One example of known alignment devices includes a mushroom-shaped pin that is fixed in an aperture of the tappet assemblies' bucket. Such pins can be difficult to manufacture because of their complicated shapes. As well, required heat treatments of the bucket can cause distortion of the aperture which receives the alignment device, thereby complicating assembly. Such alignment devices are often fixed in their corresponding apertures by an interference fit.

The present invention recognizes and addresses considerations of prior art constructions and methods.

SUMMARY OF THE INVENTION

One embodiment of the present disclosure provides a tappet assembly movable within a bore along a longitudinal center axis of the bore, the assembly including an outer cup having an inner surface and an unground outer surface defining a substantially cylindrical side wall, an annular lip portion disposed at a first end of the side wall, and an annular ledge disposed on the inner surface of the side wall, the annular ledge being disposed in a plane that is transverse to a longitudinal center axis of the tappet assembly, an inner cup including an annular lip extending outwardly therefrom and a pair of shaft apertures, the inner cup being disposed in the outer cup so that the lip of the inner cup abuts the annular ledge of the outer cup and is non-rotatably fixed thereto by the annular lip of the outer cup which abuts the lip of the inner cup, a shaft having a first end and a second end, each of the first end and the second end being disposed in a corresponding one of the shaft apertures, and a roller tappet rotatably received on the shaft such that a portion of the roller tappet extends axially outwardly beyond the annular lip portion of the outer cup, and an anti-rotation feature formed in the outer cup, wherein the outer surface of the outer cup is an unground surface.

One embodiment of the present disclosure provides a tappet assembly that is movable within a bore along a longitudinal center axis of the bore, having an outer cup having an inner surface and an outer surface defining a substantially cylindrical side wall, an annular lip portion disposed at a first end of the side wall, and a radially-outwardly extending projection formed in the side wall, an inner cup including a pair of shaft apertures and a recess formed in an outer surface of the inner cup, the inner cup being disposed in the outer cup so that the recess is disposed opposite the projection, an alignment element disposed in a cavity defined by the projection and the recess so that the inner cup is non-rotatably fixed to the outer cup, a shaft having a first end and a second end, each of the first end and the second end being disposed in a corresponding one of the shaft apertures, and a roller rotatably received on the shaft such that a portion of the roller tappet extends axially outwardly beyond the annular lip portion of the outer cup.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used herein, terms referring to a direction or a position relative to the orientation of the tappet assembly, such as but not limited to "vertical," "horizontal," "upper," "lower," "above," or "below," refer to directions and relative positions with respect to the assembly's orientation in its normal intended operation, as indicated in the Figures herein. Thus, for instance, the terms "vertical" and "upper" refer to the vertical direction and relative upper position in the perspectives of the Figures and should be understood in that context, even with respect to a tappet assembly that may be disposed in a different orientation.

Further, the term "or" as used in this disclosure and the appended claims is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Throughout the specification and claims, the following terms take at least the meanings explicitly associated herein, unless the context dictates otherwise. The meanings identified below do not necessarily limit the terms, but merely provided illustrative examples for the terms. The meaning of "a," "an," and "the" may include plural references, and the meaning of "in" may include "in" and "on." The phrase "in one embodiment," as used herein does not necessarily refer to the same embodiment, although it may.

Figure 6:
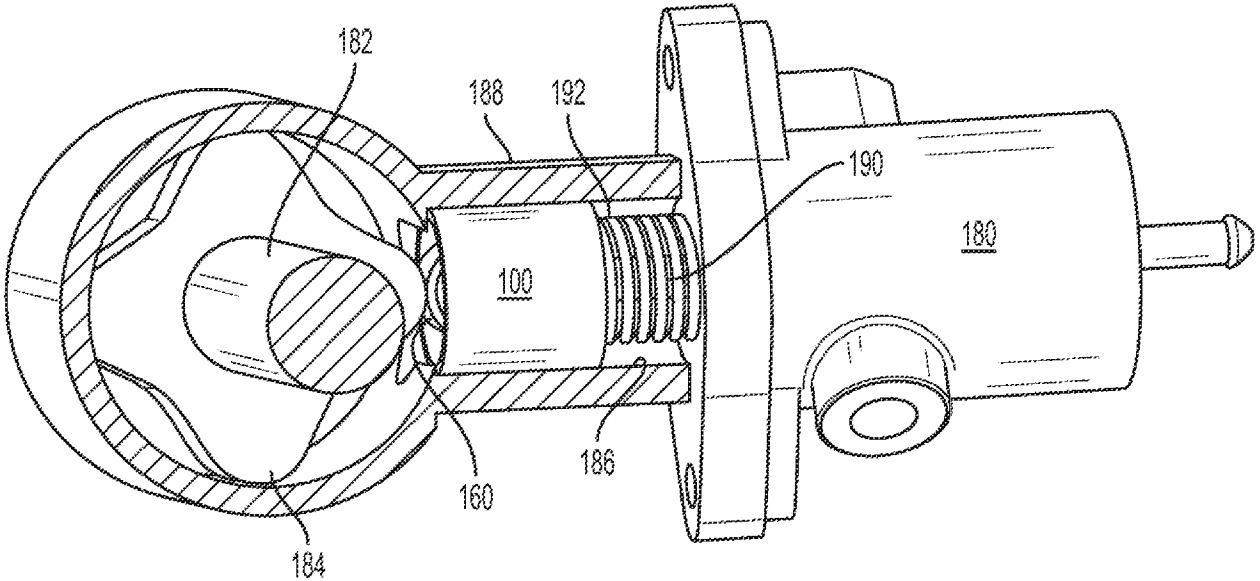
FIG. 6 is a partial cross-sectional view of a high pressure fuel pump including the tappet assembly shown in FIGS. 1A and 1B.

As shown in FIG. 6, a tappet assembly 200 in accordance with the present disclosure is used in a high-pressure fuel pump 180 of an internal combustion engine, although other uses for tappet assembly 200 are possible. As a camshaft 182 of the engine rotates, a lobe 184 of camshaft 182, or a rocker arm (not shown) connected to camshaft 182, engages roller tappet 160 of tappet assembly 200 to convert the rotational motion of camshaft 182 into linear motion of tappet assembly 200 within a bore 186 of a corresponding cylinder head 188. A pump stem 190 of pump 180 is positioned within and connected to tappet assembly 200 such that, as tappet assembly 200 moves in a linear direction within bore 186, pump stem 190 is alternatingly moved left (as shown) by spring 192 and right by tappet assembly 200. Forces from camshaft 182 are thereby transmitted through tappet assembly 200 to pump 180.

Figure 1A:
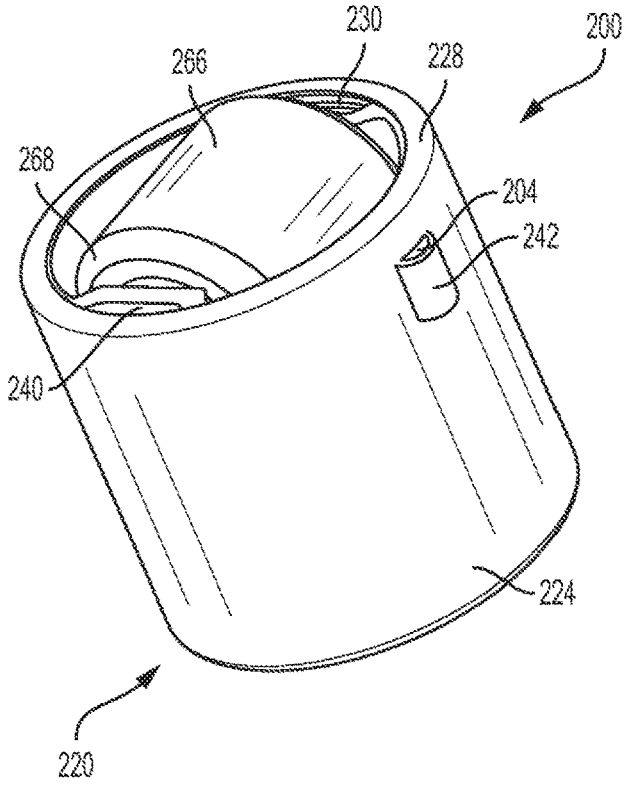
FIGS. 1A and 1B are perspective views of an embodiment of a tappet assembly in accordance with the present disclosure.
Figure 1B:
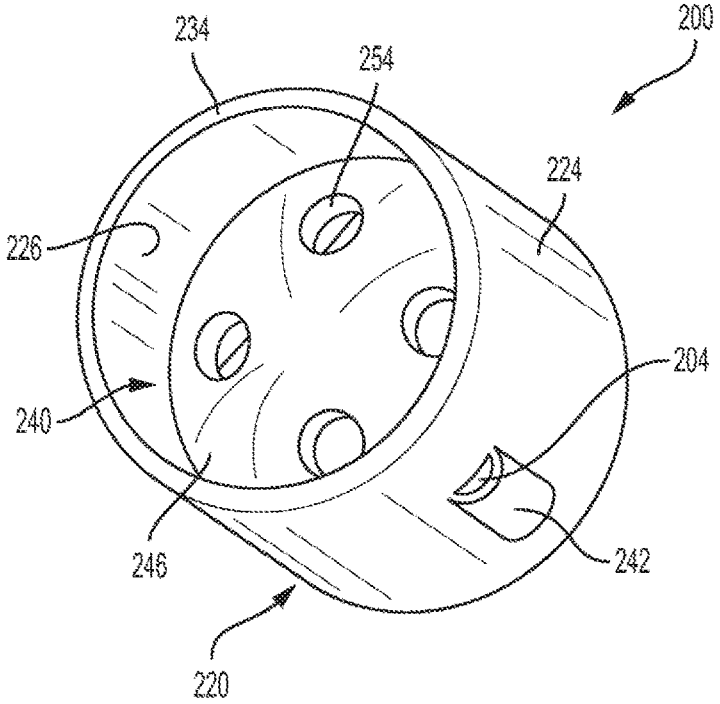
Figure 2:
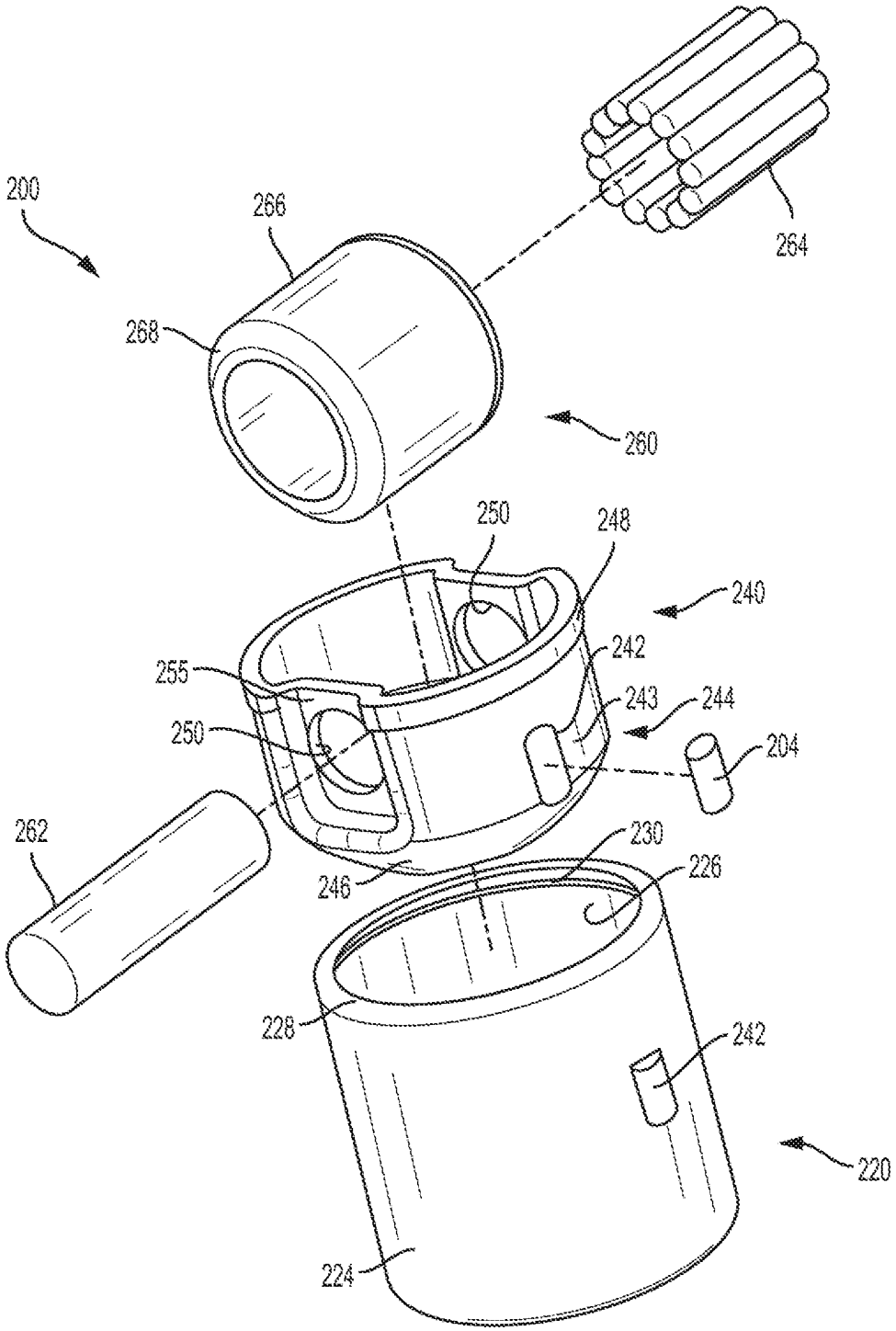
FIG. 2 is an exploded perspective view of the tappet assembly shown in FIGS. 1A and 1B.
Figure 3A:
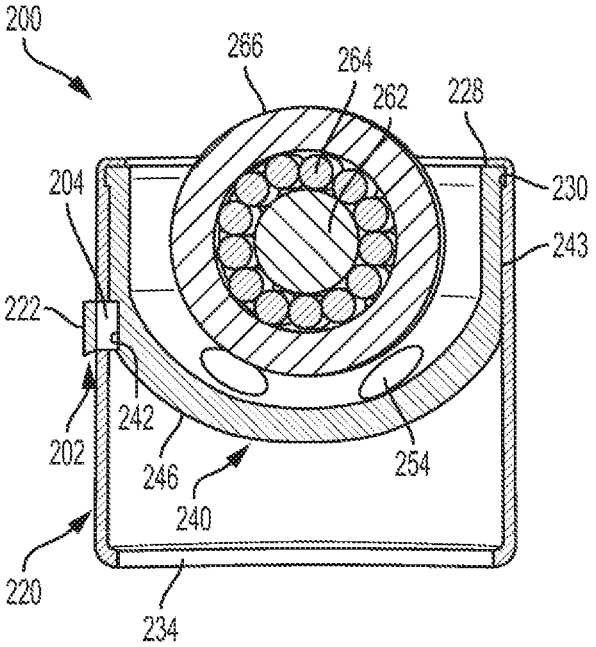
FIGS. 3A, 3B, 3C, and 3D are cross-sectional views of the tappet assembly shown in FIGS. 1A and 1B.
Figure 3B:
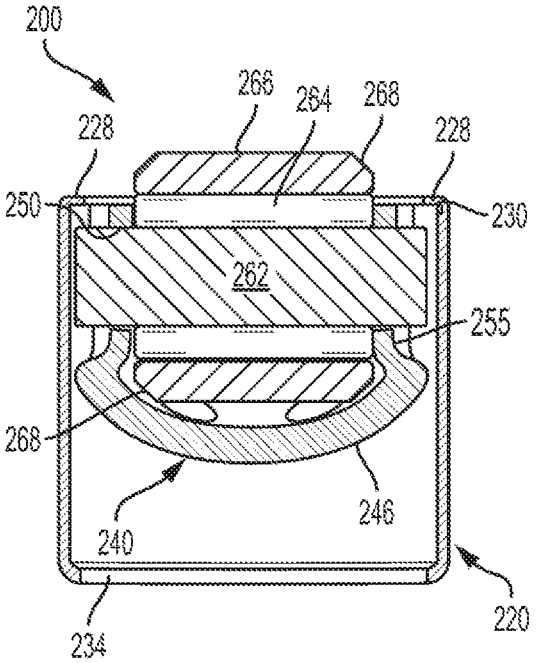
Figure 3C:
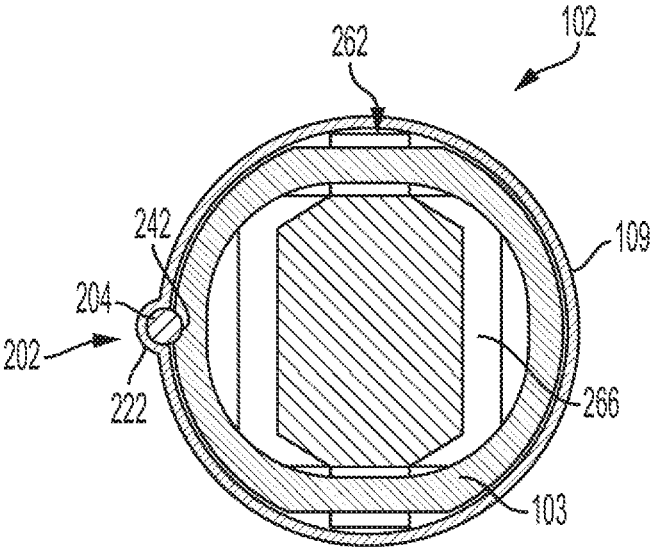
Figure 3D:
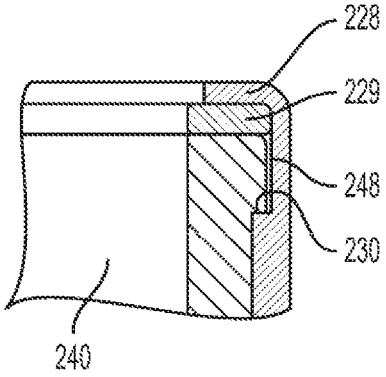

As shown in FIGS. 1A through 3D, the tappet assembly 200 in accordance with the present disclosure includes a substantially cylindrical outer cup 220, an inner cup 240 received therein, a roller follower 260 supported by inner cup 240, and an alignment device 202 formed by a cylindrical pin 204 that is partially received in both a projection 222 extending outwardly from the side wall of the outer cup 220 and a recess 242 formed in the side wall of the inner cup 240, as best seen in FIG. 3C.

Figure 5:
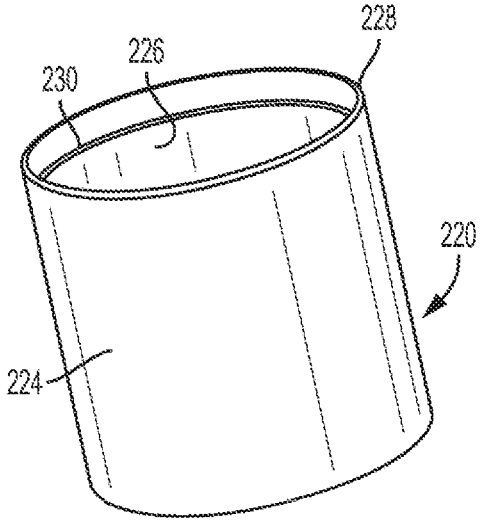
FIG. 5 is a perspective view of an outer cup of the tappet assembly shown in FIGS. 1A and 1B.

Referring additionally to FIG. 5, outer cup 220 of tappet assembly 200 includes a cylindrical outer surface 224, a cylindrical inner surface 226 substantially concentric therewith, and an outwardly extending projection 222 that is configured to receive alignment pin 204 therein. As shown, projection 222 is generally semi-cylindrical in shape so that it forms a recess 223 that is also semi-cylindrical in shape for receiving alignment pin 204 therein. Recess 223 is accessible for insertion of alignment pin 204 only from the interior of outer cup 220. As noted, alignment projection 222 includes a semi-cylindrical outer surface, the cross-section of which is correspondingly shaped to the alignment groove (not shown) that is formed in the corresponding cylinder head 188 (FIG. 6). Outer cup 220 is preferably formed from a sheet metal blank of low, medium, or high carbon plain or alloy steel by a precision drawing process that results in very good control of the surface finish, the outer diameter size, and roundness of the outer cup. Projection 222 is preferably formed by piercing, although it may be machined or otherwise cut into outer cup 220. Additionally, outer cup 220 includes an annular lip 228 and 234 formed at each of its opposing ends. Annular lip 228 is thinner in the radial direction than the remaining side wall of outer cup 220, forming an annular ledge 230 therewith. Prior to fully assembling tappet assembly 200, annular lip 228 extends axially outwardly parallel to a longitudinal center axis 232 of outer cup 220, whereas annular ledge 230 lies in a plane that is transverse to longitudinal center axis 232. When forming outer cup 220, annular lip 234 may be initially formed extending radially inwardly as the other components of the roller follower are preferably placed into outer cup 220 from the end at which annular lip 228 is disposed.

Figure 4A:
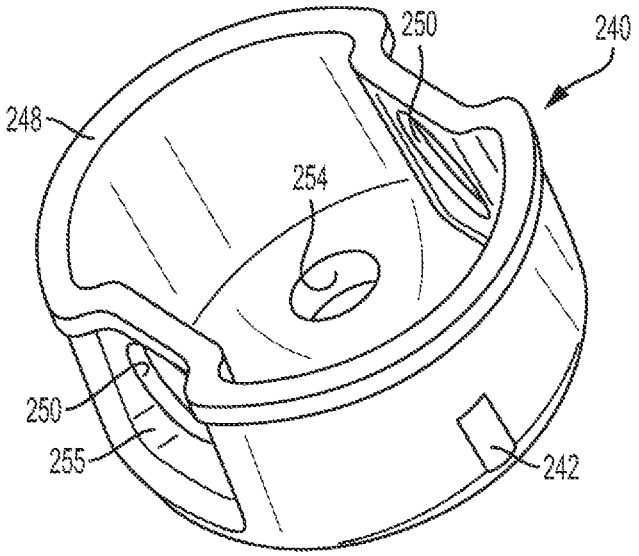
FIGS. 4A and 4B are perspective views of an inner cup of the tappet assembly shown in FIGS. 1A and 1B.
Figure 4B:
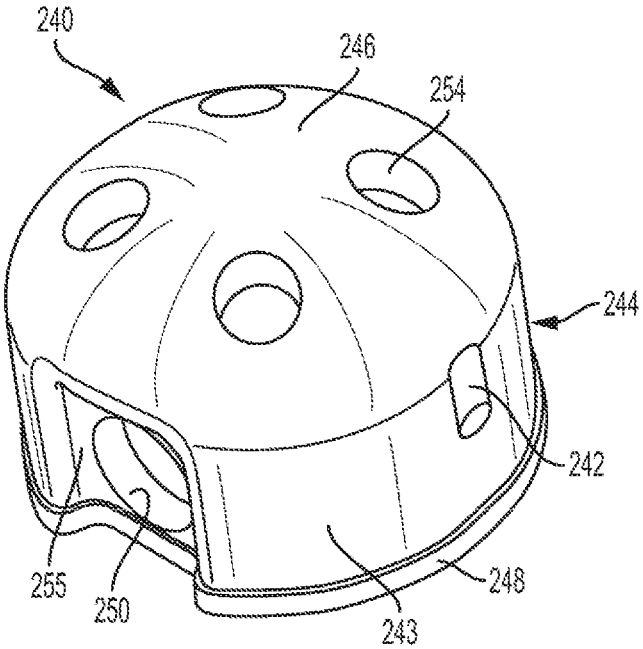

Referring additionally to FIGS. 4A and 4B, inner cup 240 of tappet assembly 200 preferably includes a side wall 244 including two opposed curved portions 243 with two parallel side portions 255 extending therebetween, a semi-spherical bottom portion 246, an upper lip 248 extending radially outwardly from an upper perimeter of side wall 244, a pair of shaft apertures 250 defined by side wall 244, and a semi-cylindrical recess 242 that is configured to receive alignment pin 204 therein formed in one of the two opposed curved portions 243 of the side wall. As best seen in FIGS. 1A, 3A, and 3B, when fully inserted in outer cup 220, upper lip 248 of inner cup 240 rests on annular ledge 230 of outer cup 220 so that alignment pin 204 is retained between the inner and outer cups. Prior to inserting inner cup 240 into outer cup 220, alignment pin 204 is positioned in projection 222. As inner cup 240 is positioned in outer cup 220, alignment pin 204 is slidably received in recess 242 of inner cup 240, thereby retaining the alignment pin 204 in the tappet assembly 200.

Once fully inserted in outer cup 220 and rotationally positioned by way of the alignment pin 204 engaging both the outer cup and the inner cup, inner cup 240 is retained therein by folding annular lip 228 over inwardly, such as by crimping, spin curling, punch forming, etc., so that upper lip 248 is non-rotatably squeezed between annular lip 228 and annular ledge 230. Note, in alternate embodiments, a spacer 229 may be positioned between annular lip 228 and annular ledge 230. Spacer 229 helps insure that any potential gaps between lip 228 and ledge 230 are minimized. Spacer 229 is preferably formed from a plastic or a like material. Note, since outer cup 220 does not directly support shaft 262 of roller follower 260, it does not require the heat treatment processes that are typically performed on the outer cups of known tappet assemblies. As such, the folding/crimping operation performed on annular lip 228 is facilitated. However, in those applications where heat treatment of outer cup 220 is desired for wear purposes, the heat treatment process occurs after alignment projection 222 is formed. Next, prior to folding, crimping, etc., annular lip 228 over inwardly, annular lip 228 is tempered to facilitate the operation and help prevent cracking.

Preferably, inner cup 240 is formed from a sheet metal blank by a stamping process, or drawing process, and is subjected to heat treatment processes as it directly supports shaft 262 of tappet assembly 200. Initially, side wall 244 is substantially cylindrical when inner cup 240 is formed. However, prior to the heat treatment process, flat side portions 245 are formed, resulting in the side portions 245 extending between two opposed curved portions 243. As well, prior to the heat treatment processes, shaft apertures 250 are pierced in flat side portions 245 of inner cup 240. Lubrication apertures 254 are also pierced in semi-spherical bottom portion 246 of inner cup 240 prior to any heat treatment processes. Although not shown, a portion of semi-spherical bottom portion 246 may be flattened, thereby forming a bottom wall that is perpendicular to longitudinal center axis 232 of tappet assembly 200.

As best seen in FIG. 2, roller follower 260 includes shaft 262, an outer race 266, and a plurality of rollers 264 disposed therebetween such that race 266 is freely rotatable about shaft 262. Opposite ends of shaft 262 are received in shaft apertures 250 of inner cup 240. When assembled, roller follower 260 extends axially outwardly beyond the top edge of outer cup 220 such that outer surface of race 266 engages a corresponding lobe 184 of camshaft 182, as shown in FIG. 6. Preferably, the diameters of shaft apertures 250 are slightly larger than the diameter of shaft 262 such that shaft 262 is free to rotate therein. Alternately, the opposing ends of shaft 262 can be staked, swaged, etc., to inner cup 240 such that rotation relative thereto is prevented. Note, when shaft 262 is free to rotate within shaft apertures 250, the axial motion of shaft 262 is limited by abutment at either end with inner surface 226 of outer cup 220. Note, unlike the previously discussed embodiment, the flat inner surfaces of parallel side portions 255 of inner cup 240 negate the need for washers at opposite ends of rollers 264. Preferably, annular beveled edges 268 are provided on the opposite ends of outer race 266 to allow the overall size of outer race 266 to be maximized, yet not make contact with the rounded bottom corners of inner cup 240.

Known gasoline direct injection (GDI) tappet assembly designs require grinding the outside diameter of their respective outer cups to insure that the diameter and roundness tolerances will be tight enough to control the tappets in the housing bore under the extreme conditions often experienced in GDI applications. In contrast, the presently disclosed tappet assemblies have unique capabilities that allow them to function in the GDI's extreme conditions, as well or better than existing GDI tappet designs. These capabilities are possible due to the fact that the outer cup 220 is decoupled from the load path and how the tappet assembly 200 does not utilize an outer cup with a ground outer surface. As noted, a ground outer surface is not required due to forming the outer cup 220 by way of a precision drawing process. In the disclosed embodiments, the outer cup 220 is almost an entirely unbroken cylinder, less the alignment device 202. This maximizes the stability of the tappet assembly 200 while also maximizing the oil film that builds between the tappet assembly 200 and the housing bore. The enhanced oil film and stability improves the lubrication thus reducing the potential for metal-to-metal contact between tappet assembly 200 and the housing bore. Prior art tappet assemblies tend to have relieved portions of the outer cup that reduce the overall area for allowing the build-up of an oil film, and therefore reduce the lubrication between the housing and the tappet assembly 200. Further, since the outer cup 220 of the disclosed embodiments is unground, the tappet assemblies of the present disclosure may utilize an alignment device 202 that is formed into the side wall of the outer cup, as previously discussed. The alignment device 202 is required in all GDI tappet designs to control the angular position of the tappet assembly 200 during operation. Moreover, because the load path does not go through the outer cup 220 of the tappet assembly 200, the outer cup 220 can be designed with a lower stiffness than in known tappet assemblies, allowing for increased outer cup conformity to the housing bore.

As well, not grinding the outer surface of the outer cup 220 offers efficiencies in manufacturing. In known prior art tappet designs that use a ground outer cup, the grinding operation or the outer surface makes it impractical to form the alignment device 202 into the outer cup because the grinding operation necessarily occurs after the forming of the alignment device 202. Therefore, the formed alignment device 202 would interfere with the grinding process and require very expensive process techniques to attempt to support grinding the outer cup with a previously formed alignment device 202, or the alignment device 202 would have to be formed after the outer cup is already in the hard state. Moreover, because the load path does not go through the outer cup 220 of the tappet assembly 200, the outer cup 220 can be designed with a lower stiffness than in known tappet assemblies, allowing for increased outer cup conformity to the housing bore.

While one or more preferred embodiments of the invention are described above, it should be appreciated by those skilled in the art that various modifications and variations can be made in the present invention without departing from the scope and spirit thereof. It is intended that the present invention cover such modifications and variations as come within the scope and spirit of the appended claims and their equivalents.

The invention claimed is:

1. A tappet assembly movable within a bore along a longitudinal center axis of the bore, the tappet assembly comprising:

an outer cup having an inner surface and an outer surface defining a substantially cylindrical body, an annular lip portion disposed at a first end of the outer cup, and an annular ledge disposed on the inner surface, the annular ledge extending perpendicular to the longitudinal center axis of the bore;

an inner cup including an outwardly extending annular lip and first and second shaft apertures, the inner cup being disposed in the outer cup such that the annular lip of the inner cup abuts the annular ledge;

a shaft having a first end and a second end disposed in the first and second shaft apertures, respectively;

a roller follower rotatably received on the shaft such that a portion of the roller follower extends axially outwardly beyond the annular lip portion of the outer cup; and an anti-rotation feature formed in the outer cup, wherein the outer surface of the outer cup is an unground surface, and wherein the annular lip portion of the outer cup is deformed such that the annular lip of the inner cup is squeezed between the annular ledge and the annular lip portion of the outer cup so as to fix the inner cup to the outer cup.

2. The tappet assembly of claim 1, wherein the inner cup further comprises a side wall including two opposed curved portions, a pair of parallel side portions extending between the two curved portions, and a semi-spherical bottom portion disposed at a bottom end of the side wall, wherein the annular lip of the inner cup extends radially outwardly from a top end of the side wall.

3. A tappet assembly movable within a bore along a longitudinal center axis of the bore, the tappet assembly comprising:

an outer cup having an inner surface and an outer surface defining a substantially cylindrical side wall, an annular lip portion disposed at a first end of the outer cup, and a radially-outwardly extending projection formed in the side wall;

an inner cup including first and second shaft apertures and a recess formed in an outer surface of the inner cup, the inner cup being disposed in the outer cup such that a cavity is defined by the projection and the recess;

an anti-rotation element disposed in the cavity so as to fix the inner cup to the outer cup;

a shaft having a first end and a second end disposed in the first and second shaft apertures, respectively; and a roller follower rotatably received on the shaft such that a portion of the roller follower extends axially outwardly beyond the annular lip portion of the outer cup.

4. The tappet assembly of claim 1, wherein the anti-rotation element is a cylindrical pin.

* * * * *